United States Patent [19]

Fischer

[11] 4,447,711

[45] May 8, 1984

[54] ELECTRIC HEATER

[76] Inventor: Karl Fischer, Am Gänsberg 23, D-7519 Oberderdingen, Fed. Rep. of Germany

[21] Appl. No.: 333,811

[22] Filed: Dec. 23, 1981

[30] Foreign Application Priority Data

Dec. 30, 1980 [DE] Fed. Rep. of Germany ..... 3049521

[51] Int. Cl.[3] ..... H05B 3/68

[52] U.S. Cl. ..... 219/464; 219/449; 219/460; 219/462; 219/467; 428/256

[58] Field of Search ..... 219/213, 449, 452, 460, 219/462, 463, 464, 467, 453, 456; 428/247, 256

[56] References Cited

U.S. PATENT DOCUMENTS

| | | | |
|---|---|---|---|
| 3,384,737 | 5/1968 | Doutre | 219/460 |
| 3,612,826 | 10/1971 | Deaton | 219/453 |
| 3,632,983 | 1/1972 | Dills | 219/464 |
| 3,646,321 | 2/1972 | Siegea | 219/464 |
| 3,833,793 | 9/1974 | McWilliams et al. | 219/464 |
| 4,166,878 | 9/1979 | Thompson et al. | 428/256 |
| 4,243,874 | 1/1981 | Fischer | 219/449 X |

FOREIGN PATENT DOCUMENTS 2820139 11/1979 Fed. Rep. of Germany ..... 219/464

*Primary Examiner*—Volodymyr Y. Mayewsky
*Attorney, Agent, or Firm*—Steele, Gould & Fried

[57] ABSTRACT

An electric hotplate, having an insulator bearing at least one electrical heating resistor, comprising: a metal plate heatable by the at least one electrical heating resistor, having substantially flat upper and lower surfaces and a downwardly directed rim near its outer circumference, the rim and lower surface defining a space therebetween, and the upper surface forming a cooking surface for receiving cooking vessels placed thereon; the insulator having a plurality of insulating layers, the at least one heating resistor being disposed on the upper surface of the uppermost layer; a basket-shaped metal lattice surrounding the insulator about its outer surface and holding the plurality of insulating layers together, the insulator and metal lattice forming an independently positionable heater/insulator assembly; and, fasteners at the rim for engaging the metal lattice and holding the heater/insulator assembly in position at least partly in the space.

20 Claims, 13 Drawing Figures

FIG. 3
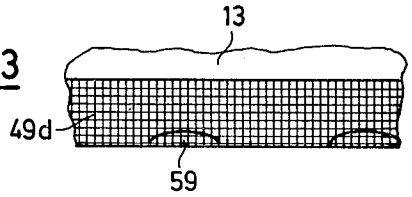
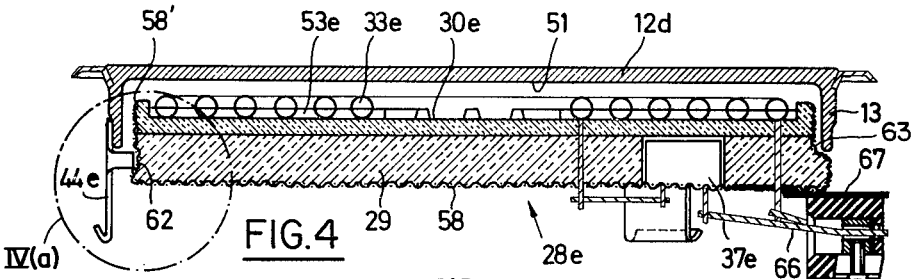
FIG. 4
FIG. 4(a)
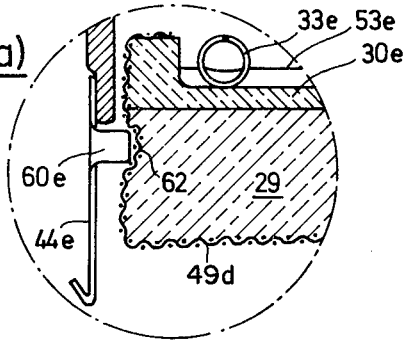
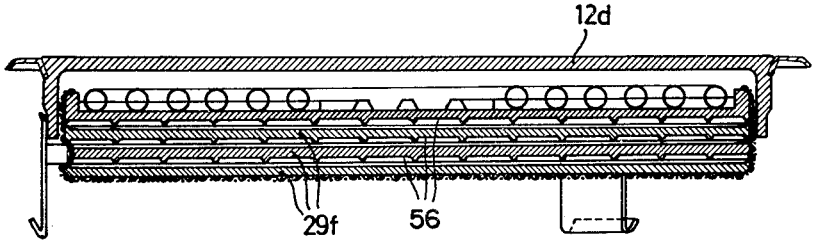
FIG. 5

ELECTRIC HEATER

BACKGROUND OF THE INVENTION

The invention relates to an electric hotplate. The published specification of German application No. 28 20 139 describes a heater comprising an insulator carrying the electric heating resistors, the outside of the insulator being surrounded by a reinforcement of a metal lattice or screen, e.g. a wire netting or expanded metal mesh.

SUMMARY OF THE INVENTION

It is an object of this invention to further improve the characteristics of this heater, particularly with regard to the ease of use and operation as well as the strength insulating properties of the insulator.

According to the invention this object is solved in that the insulator from a plurality of insulating layers held together by the metal lattice.

The multilayer nature of the insulator makes it possible to so construct the insulating materials that they can in each case be used in an optimum manner corresponding to their particular function. Thus, for example, a relatively thin upper insulating layer can be made from a mechanically stronger insulating material which carries the heating resistors, while the lower layer is mainly selected for its good insulating properties. Everything is held together by the metal lattice, so that a more handy article is obtained, which can be advantageously used in this form for the direct heating of the bottom of the glass ceramic plate or, in conjunction with a metal plate having lateral flanges, can be used as an individual hotplate. In most cases it is not necessary to provide a further lower covering, e.g. a sheet metal covering on the bottom of the hotplate because the metal lattice not only ensures adequate strength, but can also be electrically grounded. In conjunction with open heater coils the invention can be used for radiant heating purposes or in conjunction with tubular heaters in which the heating resistors are arranged, in insulated manner, in a usually triangular metal shell. In each case the uppermost insulating layer carries the heater coils or the tubular heaters, preferably on projecting ribs. In the case of contact heaters (tubular heaters) adequate pressing against the metal or glass ceramic plate is ensured through springs acting on the bottom of the insulator, i.e. the lower part of the metal lattice.

Air gaps can be formed by ribbing between the individual insulating layers preferably terminated by circumferential edge ribs, which contribute further to the improvement of the insulating properties, without leading to any increase in the thermal inertia. The ribbing should be constructed in such a way that the spacing is maintained under all circumstances, e.g. by a combination of circular and radial ribs.

Temperature protection switches or other temperature-sensitive switching members may be advantageously incorporated into the insulator. The complete switch body can be arranged within the insulator and in certain circumstances the uppermost insulating layer can be used for shielding the switch body which has a lower temperature resistance. In a construction of a temperature switch with a rod-shaped thermostat, the switch head can be arranged outside the insulator, only the rod-shaped thermostat projecting at right angles to the insulator. It is preferably located in a recess of one of the lower insulating layers, whereas the upper insulating layer has openings in the vicinity of the thermostat in order to ensure a good, and as far as possible, delay-free thermal coupling between the thermostat and the heating resistors. To this end additional coupling members can be provided, such as e.g. a channel-like reflector positioned under the thermostat. From the radiation standpoint, the coupling member may be formed in the manner of a parabolic mirror, or a thermal conduction bridge between a tubular heater and the thermostat, which projects through one of the openings.

BRIEF DESCRIPTION OF THE DRAWINGS

Further advantages and features of the invention can be gathered from the following description in conjunction with the drawings, the represented and described features being advantageous either singly or in random combinations, particularly in combination with other constructional variants. The invention is described in greater detail hereinafter relative to non-limitative embodiments and the attached drawings, wherein:

FIG. 1(*a*) is an enlarged view of the circled area in FIG. 1 designated I(*a*).

FIG. 3 is a side view of the lower edge of the hotplate of FIG. 1.

FIGS. 4–6 are vertical sections through further embodiments of an electric hotplate.

FIG. 4(*a*) is an enlarged view of the circled area in FIG. 4 designated IV(*a*).

FIG. 6(*a*) is an enlarged view of the circled area in FIG. 6 designated VI(*a*).

DETAILED DESCRIPTION OF THE PREFERRED EMBDOIMENTS

Figure 1:
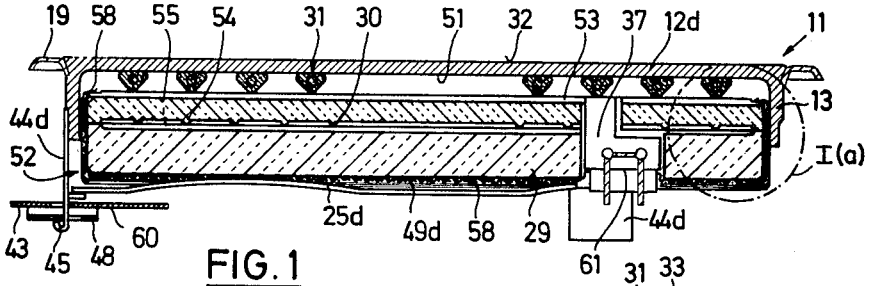
FIG. 1 is a vertical section through an electric hotplate according to this invention.
Figure 1A:
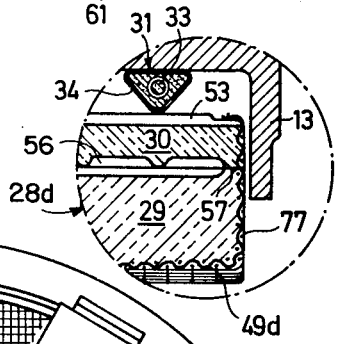
Figure 2:
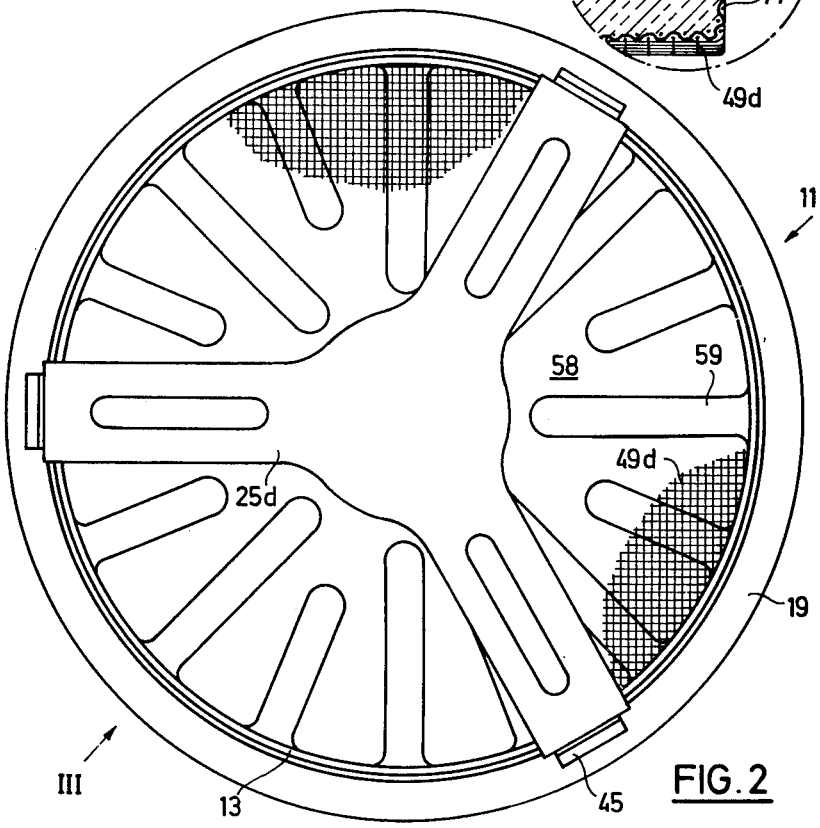
FIG. 2 is a view from below of the hotplate of FIG. 1.

FIGS. 1 to 3 show an electric hotplate 11 having a heatable plate 12*d*, which is in the form of a substantially planar and relatively thin steel or cast material plate.

It has an upper planar cooking surface 32 and a lower, also planar bottom surface 51 against which are pressed the tubular heaters 31 for contact heat transfer. As is known in the art, the tubular heaters comprise internal, usually spiral heating resistors 33 placed in an electrically insulating embedding material and surrounded by a thin, stainless steel tubular casing 34, which is pressed into a triangular shape giving an upper contact surface engaging on bottom surface 51. Due to the good heat transfer characteristics from the tubular heater to cooking surface 32 resulting from the limited spacing between the heating resistor and plate 12*d* and due to the good heat transfer of the highly compressed embedding material in the tubular heater and good transverse thermal conduction in plate 12*d*, the tubular heaters can be positioned with relatively large spacing gaps, which are larger than the widths of the actual tubular heaters, while still producing an adequate power density.

On the outer periphery of plate 12*d* is shaped a downwardly directed, substantially cylindrical outer edge 13 having in its upper area adjacent to cooking surface 32 an inclined slot for receiving an outer ring 19 made from a stainless steel-metal material. Thus, the plate is shaped like an inverted flat box, whose interior receives the heater/insulator assembly 52 constructed as an integrated or self-contained unit. It has an insulator 28*d* which, in the represented embodiment, comprises two insulating layers 29, 30 held together by a metal lattice or screen 49*d*.

The upper insulating layer 30 is shaped like a relatively thin disk made from a mechanically stronger (relative to layer 29) and more thermally stable insulating material, pressed e.g. from mineral fibres, such as those known under the trade name "Fiberfrax." On its top surface it has radially directed ribs 53 on which rest the tubular heaters 31. Insulating layer 30 also has ribbing 54 on its bottom surface, but in the represented embodiment the ribbing is in the form of concentric circles. Once again radially directed ribs 55 of the lower insulating layer 29 cooperate with the ribbing 54, so that an air gap 56 is formed between insulating layers 29 and 30, said air gap being substantially sealed from the outside because the outermost circular rib 54 rests on a circular rib 57 of the lower insulating layer 29 and which passes round the outer periphery.

Figure 13:
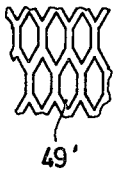
FIG. 13 is a partial plan view of an expanded metal mesh.

Insulating layers 29, 30 are held together by metal lattice 49*d*, which is a relatively fine-mesh steel wire netting with mesh sizes of approximately 2 mm. However, the metal lattice can also be in the form of other types of wire netting or expanded metal lattices 49' (see FIG. 13) can be used produced from a metal sheet by slitting and expanding at right angles to the slit direction, so that a roughly flat hexagonal honeycomb structure is obtained.

The metal lattice 49*d* is shaped like a flat, circular tray and receives in it the two insulating layers. The upper edge 58 is bent inwards over the edge of the upper insulating layer, so that both insulating layers are firmly held together. The heater/insulator assembly 52 is produced in such a way that initially a dish is formed from the metal lattice, which still has somewhat conical sidewalls, rather than cylindrical sidewalls. The material for the lower insulating layer 29 formed by a mechanically less strong material (relative to layer 30), but which has very good insulating properties and a good thermal stability, e.g. an inorganic compression molding material formed from short fibres or a pulverulent material, whereby the mixture can optionally be mixed with a binder, is compressed into the metal lattice dish, so that ribs 55 are also produced. The second layer, to which the tubular heaters 31 are optionally fixed is then placed on it and the metal lattice is shaped into its final shape with cylindrical sidewalls and an inwardly bent edge. The bottom 58 of the metal lattice 49*d* is profiled, together with the bottom of layer 29, so that preferably radial or star-shaped recesses 59 are formed (FIG. 3). They not only reinforce the bottom surface, but in particular combined with a compression spring 25*d* prevent twisting of heater/insulator assembly 52 relative to plate 12*d*.

As can be gathered from FIG. 2 the compression spring 25*d* is shaped like a three-armed star and is made from a spring plate, whose arms are bent in such a way that they press with their central area against metal lattice 49*d*, while the arm ends rest on projection 60 of strap-like fastening elements 44*d*. Three of these fastening elements 44*d* are peripherally welded to the edge 13 of plate 12*d* and project substantially vertically downwards. They have barbs 45 on their lower end which pass through a lower cover tray 43 of a cooker depression or a corresponding carrying handle and consequently secure the complete hotplate 11. This fastening is preferably resiliently performed by means of a leaf spring 48 positioned underneath.

Thus, insulator 28*d* is pressed upwards by compression springs 25*d*, so that the relatively thin, flexible, spirally wound tubular heaters are resiliently pressed against the bottom surface 51 of plate 12*d*. Metal lattice 49*d* forms the lower surface of the insulator and consequently also the lower surface of the hotplate 11. Thus, no separate covering plate is required. As the metal lattice can be grounded, the electrical safety is guaranteed.

A temperature protection switch 37 is inserted in a recess of the insulator and is held in place in that its lower shoulder 61 is supported on the edge of a recess in metal lattice 49*d*. As a result its connection ends with the insulation surrounding them are freely accessible from the outside. The switch body of the temperature protection switch 37 is located in a recess of the lower insulating layer 29, while the part containing the thermostat, e.g. a bimetal member, projects through a narrower recess is the upper insulating layer 30 and engages on the bottom surface of a tubular heater 31 in order to sense its temperature in an optimum delay-free manner.

Thus, the upper insulating layer 30 protects the more temperature-sensitive part of the temperature protection switch against excessive heating.

FIGS. 4 and 4(*a*) show a variant which, other than for the following differences, coincides with that of FIGS. 1 to 3. The lower insulating layer 29, corresponding to that described hereinbefore, is placed in the metal lattice dish 49*d* of insulator 28*e*. The upper insulating layer 30*e* has a flat recess on its top surface, so that the edge 58' of the metal lattice engages on an upwardly projecting edge of insulating layer 30*e*. Radial ribs 53*e* are formed on the top surface of insulating layer 30*e*, the spiral heating resistors 33*e* being partly pressed into the ribs during the shaping of insulating layer 30*e*. Pressing in takes place in such a way that in the vicinity of the ribs the wire cross-section of the heater coils is surrounded by the insulating material, but the complete coil circumference is not covered by said material. In the area between the radial ribs the heating resistors run along the surface of insulating layer 30*e* in a substantially unembedded form. It is known from German Pat. No. 27 29 929, corresponding to U.S. Pat. No. 4,243,874 to fix the heating resistors in this way. It provides a particularly effective radiant heater in which the heating resistors are fixed in a reliable and easily manipulatable manner on the plate-like, upper insulating layer 30*e*, without there being any danger of partial overheating at the fixing points or of a detachment of the heating resistors.

The insulator 28*e* constructed in this way is fitted to the bottom surface of a plate 12*d* which, as in the case of FIGS. 1 to 3, constitutes a hotplate which can be incorporated into a cooker depression of a stove or countertop range. The insulator is installed in such a way that the heating resistors 33*a* are spaced from the bottom surface 51 of plate 12*d*. However, due to the very satisfactory fixing of the heating resistors 33*e* to the upper insulating layer 30*e*, which has no tendency to curve upwards, and due to the possibility of grounding plate 12*d* and metal lattice 49*d*, this spacing distance can be very small, so that not only is the overall height limited, but also the radiant heat transfer to plate 12*d* is very good.

Insulator 28*e* is fixed to the plate by projections 60*e* in the form of lateral, upright tongues of fastening members 44*e*, which like those in FIG. 1, engage in recesses 62 on the outer periphery of the metal lattice dish 49*d* (cf. detail in the dot-dash circle in FIG. 4).

A projecting shoulder 63 resting on the lower edge of edge part 13 can also be provided in the vicinity of the outer circumference of the metal lattice dish (cf. right-hand part of FIG. 4).

A temperature protection switch 37*e* rests flat in a recess of the lower insulating layer 29 and is completely covered by the upper insulating layer 30*e* in order that it is not directly exposed to the high temperatures of heating resistors 33*e*.

FIGS. 4 and 4(*a*) also show the hotplate connection 64 comprising a conventional connection member 65 into which pass the internal connecting leads 66 and are connectable there with the external connecting leads. The connection member 65 is fixed to a connection plate 67, which projects over the edge of the hotplate and is fitted to the base portion 58 of metal lattice 49*d* by spot welding or other fastening means. It is pointed out in this connection that the fitting of parts to the metal lattice is particularly simple because it can be easily accomplished with sheet-metal or wood screws.

The construction of FIG. 5 differs from that of FIGS. 4 and 4(*a*) in that the lower insulating layer 29 is replaced by a plurality of thin, plate-like insulating layers 29*f*, provided on their top and bottom surfaces with non-mating profiles, so that they produce insulating air gaps 56 between them. In this case the insulating layers could be made from a mechanically stronger material for example a ceramic material.

Figure 6:
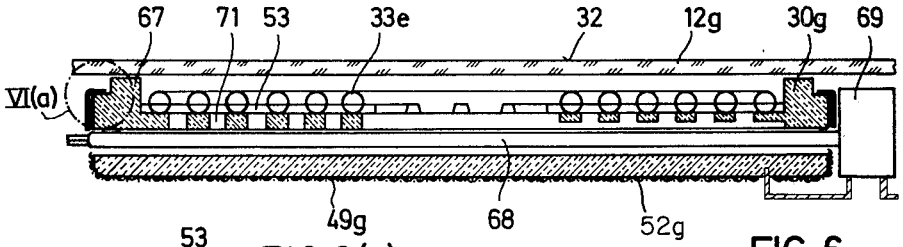
Figure 6A:
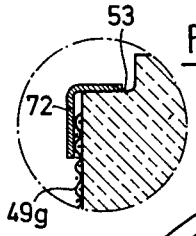
Figure 7:
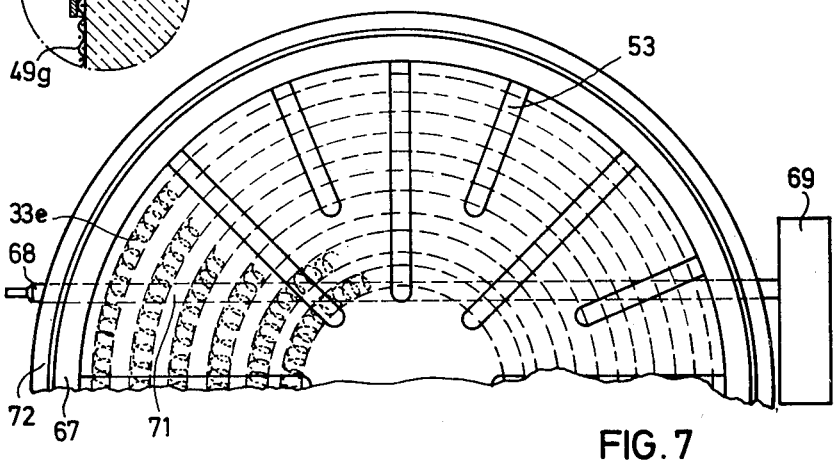
FIG. 7 is a broken-away plan view of the hotplate of FIG. 6 with a section detail VI—VI for FIG. 6.

FIGS. 6 and 6(*a*) show an electric heater/insulator assembly 52*g* which is pressed underneath a glass ceramic plate 12*g*, whose top surface forms the cooking surface 32*g*, by means of spring elements (not shown). It engages with an upwardly projecting peripheral edge 67 of the upper insulating layer 30*g* on the bottom surface of plate 12*g*.

Figure 8:
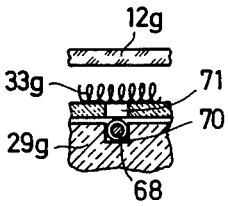
FIGS. 8–10 are different arrangements for a thermostat sectioned along line VII—VII of FIG. 7.

In a flat recess on its top surface the upper insulating layer 30*g* carries radially directed slots which, as in the case of FIGS. 4 and 5, secure spiral heating resistors 33*e*. The circular disk-shaped middle part of insulating layer 30*g* is crossed in a somewhat eccentric manner by the rod-shaped thermostat 68 of a temperature switch 69 running in a slot 70 of the lower insulating layer 29, as shown in FIG. 8. In the upper, thinner insulating layer 30*g* there are openings 71 in the thermostat area between ribs 53*e* and said openings ensure an adequate thermal coupling between the heating system and the thermostat. The head of temperature switch 69 is located outside the heater.

With the exception of the following points the metal lattice 49*g* corresponds to that of the previous drawings. It can be seen from the detail in the dot-dash circle that the upper, inwardly bent edge, formed in the previous embodiments by an inward bending of the actual metal lattice, is in this case formed by a circular sheet-metal ring 72 with an L-shaped cross-section, to whose downwardly pointing leg resting on the outer periphery of the upper insulating layer 30*g* is fitted the upwardly directed edge of the metal lattice by spot welding or the like. The horizontal L-leg rests on a shoulder 73 formed between the outer periphery of the insulator and edge 67. This ring holds together the free edge of the metal lattice and terminates it without projecting strands. In the case of a metal lattice made from expanded metal, said edge could be formed from the uninterrupted expanded metal. It is also possible to press the free edge of the metal lattice into the material of the upper insulating ring, so that as a result the free ends of the edge are covered. Here again the metal lattice holds together the two insulating layers 30*g* and 29*g*.

Figure 9:
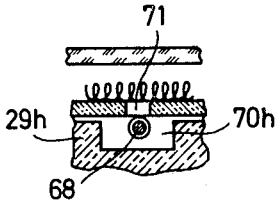

FIG. 9 shows other embodiments of the arrangement of thermostat 68. The construction of FIG. 9 corresponds to that of FIG. 8, except for the fact that the recess 70*h* in the lower insulating layer 29*h* is larger.

Figure 10:
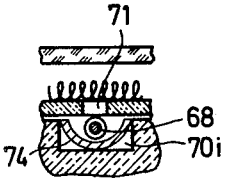
Figure 11:
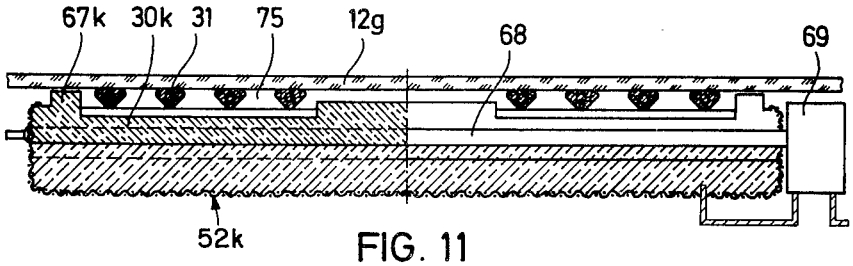
FIG. 11 is a vertical section through a further electric hotplate.

FIG. 10 shows a thermostat arrangement in which the size of recess 68*i* corresponds to that of FIG. 9. Below the thermostat is placed a reflector 74 comprising a metal sheet with an approximately semicircular cross-section running parallel below thermostat 68, whereby the radiation coming in through openings 71*i* is reflected back on to thermostat 68.

Heater/insulator assembly 52*k* is also provided for heating a glass ceramic plate 12*g*, but is in the form of a contact heater constructed as a tubular heater 31 pressed against the bottom surface of plate 12*g* by ribs of the upper insulating layer 30*k*. An outer upright edge 67*k* of the upper insulating layer 30*k* substantially seals off the space 75 formed between the plate and the insulation, but without firmly engaging with the plate. Here again the pressing action is brought about by spring elements (not sure) of a support structure for the hotplate or the hotplate mounting depression.

Figure 12:
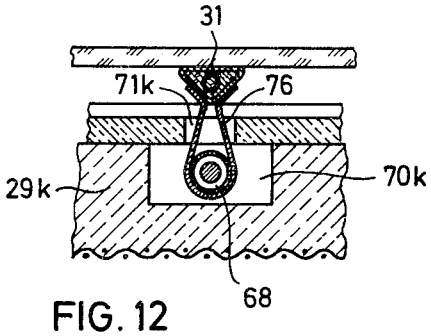
FIG. 12 is a detail section from FIG. 11.

Thermostat 68 of temperature switch 69 is housed in a recess 70*k* (FIG. 12) of the lower insulating layer 29*k*. Recess 70*k* is connected via openings 71*k* in the upper insulating layer 30*k* with space 75. FIG. 12 shows that a thermally conductive coupling part 76 extends through opening 70*k*. It comprises a sheet metal clip, which engages around the thermostat 68 and engages by two flange-like bent portions against the bottom surface of tubular heater 31. As a result a reliable coupling is brought about between the thermostat and the tubular heater.

The invention provides an electric hotplate having numerous advantages. It has a very light weight, so that even in the case of impact stresses below a glass ceramic plate it is able to follow the latter and does not form an anvil on which the plate could be destroyed. Its low thermal inertia leads to a very good efficiency and to reliability in boiling liquids in an, energy-saving fashion. Efficiency is also increased by the good insulation, and as a result the heater also has a low temperature at its base, permitting its use in lower cooker mounting depressions without any cover plate. In spite of this it has an excellent mechanical strength. It is clear that in all constructions the center of the circular cooking surfaces remains free, so that it is possible without difficulty to provide there a sensing means, e.g. a thermostat socket engaging on the bottom surface of the plate or also passing through the latter. In the case of radiant heaters a limited distance from the plate is possible (minimum contact spacing 3 mm), so that there is a good thermal coupling to the plate. The characteristics of the insulating materials are readily utilized as a result of the multilayer construction. The thin and relatively strong upper support plate ensures the holding and mounting of the heating resistors (coils or tubular heaters) and is preferably compressed from relatively strong, long, inorganic fibres, while the lower insulating layer need only have sufficient mechanical strength to enable its entire surface to take the complete contact pressure, if such a pressure exists. All the remaining supporting requirements are fulfilled by the metal lattice. In any case a handy unit is obtained, which contains the heating elements and optionally the thermostats, which can easily be fitted and replaced. A coating 77 can also be provided on the outer surfaces of the insulator, the surfaces thereof surrounding the metal lattice and optionally the top surface thereof. This coating can be e.g. a heat-resistant varnish or an organic binder coating applied by spraying. It can alternatively consist of insulating materials with a low abrasion resistance, without there being any risk of dust production. Coating preferably takes place only after the complete drying of the insulator compressed in the moist state.

The temperatures at the base of such a heater are about 80° to 100° C. lower than in the remainder of the heater. This not only improves efficiency, but also protects the environment against excessive temperatures, which reduces costs when wiring and fitting regulators and switches.

FIGS. 4 to 7 show a heater, whose heating coil is in the form of a single spiral. Advantageously two coils in the form of double spirals run substantially parallel to one another and can also be switched on separately in order to improve controllability.

What is claimed is:

1. An electric hotplate, having an insulator bearing at least one electrical heating resistor, comprising:

a metal plate heatable by the at least one electrical heating resistor, having substantially flat upper and lower surfaces and a downwardly directed rim near its outer circumference, the rim and lower surface defining a space therebetween, and the upper surface forming a cooking surface for receiving cooking vessels placed thereon;

the insulator having a plurality of insulating layers, the at least one heating resistor being disposed on the upper surface of the uppermost layer;

a basket-shaped metal lattice surrounding the insulator about its outer surface and holding the plurality of insulating layers together, the insulator and metal lattice forming an indpendently positionable heater/insulator assembly; and fastening means at the rim for engaging the metal lattice and holding the heater/insulator assembly in position at least partly in the space.

2. A hotplate according to claim 1, wherein the uppermost insulating layer comprises a shoulder and the metal lattice comprises means engaging over the shoulder.

3. A hotplate according to claim 2, wherein the engaging means comprises a sheet metal ring of angular cross-section fitted to the upper free edge of the basket-shaped metal lattice.

4. A hotplate according to claim 1, wherein the bottom surface of the metal lattice has radial recesses formed therein.

5. A hotplate according to claim 1, wherein the outer surfaces of the insulator are at least partly thermally stable.

6. A hotplate according to claim 1, wherein the uppermost insulating layer has ribs carrying the at least one heating resistor, the resistor being enclosed in a metal tubular casing to form at least one tubular heater.

7. A hotplate according to claim 1, wherein the uppermost insulating layer has ribs into which parts of spiral heating resistors are embedded.

8. A hotplate according to claim 1, wherein the insulating layers are made from compressed material and have ribbing on at least one of their upper and lower surfaces for forming air gaps between adjacent layers.

9. A hotplate according to claim 1, wherein the uppermost insulating layer is thinner than the other layers and is made from a mechanically stronger material.

10. A hotplate according to claim 1, wherein the metal plate is circular with a downwardly directed annular rim defining a substantially circular cylindrical space for receiving the heater/insulator assembly.

11. A hotplate according to claim 10, wherein the fastening means comprises fastening members in the form of tongues with barb-like bent portions adapted to cooperate with fitting elements of the hotplate.

12. A hotplate according to claim 11, further comprising at least one leaf spring-like pressing member, which is supported by the fastening members and which presses the insulator upwards.

13. A hotplate according to claim 11, wherein the fastening members comprise projections which engage in recesses formed in the metal lattice.

14. A hotplate according to claim 10, wherein the periphery of the insulator comprises a step supported on the edge of the metal plate.

15. A hotplate according to claim 1, further comprising a temperature protection switch for the at least one heating resistor disposed in the insulator, the switch having its switch part housed in a recess of a lower insulating layer, at least partly thermally screened by an upper insulating layer.

16. A hotplate according to claim 15, wherein the temperature protection switch has a thermostat projecting through the uppermost insulating layer and engaging on the bottom surface of the at least one heating resistor.

17. A hotplate according to claim 1, wherein a rod-shaped temperature sensor of a temperature switch projects horizontally through the insulator, said switch being housed in a recess of a lower insulating layer, and wherein the uppermost insulating layer has openings communicating with the at least one heating resistor in the vicinity of the temperature sensor.

18. A hotplate according to claim 17, further comprising a channel-shaped reflector for the temperature sensor positioned below the temperature sensor in the recess.

19. A hotplate according to claim 17, comprising a tubular heater in a casing and a thermally conductive coupling means disposed between and in contact with both the tubular heater and the temperature sensor.

20. A hotplate according to claim 1, wherein the heating resistor comprises two separately operable heater coils arranged in a concentric spiral pattern.

* * * * *

UNITED STATES PATENT AND TRADEMARK OFFICE

CERTIFICATE OF CORRECTION

PATENT NO. : 4,447,711

DATED : May 8, 1984

INVENTOR(S) : Fischer

It is certified that error appears in the above-identified patent and that said Letters Patent is hereby corrected as shown below:

IN THE TITLE

"ELECTRIC HEATER" should have been changed to --ELECTRIC HOTPLATE WITH HEATER/INSULATOR ASSEMBLY--.

Column 3, line 7, "steel-metal" should be --sheet-metal--.

Column 4, line 29, "is" should be --in--.

Column 6, line 67, "readily" should be --ideally--.

Signed and Sealed this

*Twenty-fifth* Day of *June 1985*

[SEAL]

*Attest:*

DONALD J. QUIGG

*Attesting Officer* *Acting Commissioner of Patents and Trademarks*